US007886905B2

(12) United States Patent
Kamada

(10) Patent No.: US 7,886,905 B2
(45) Date of Patent: Feb. 15, 2011

(54) STORAGE CONTAINER

(75) Inventor: Katsuyoshi Kamada, Higashi-Osaka (JP)

(73) Assignee: Goriki Kogyo Co., Ltd., Osaka-shi, Osaka (JP)

( * ) Notice: Subject to any disclaimer, the term of this patent is extended or adjusted under 35 U.S.C. 154(b) by 242 days.

(21) Appl. No.: 12/000,201

(22) Filed: Dec. 10, 2007

(65) Prior Publication Data

US 2008/0257766 A1 Oct. 23, 2008

(30) Foreign Application Priority Data

Apr. 23, 2007 (JP) ..... 2007-113089

(51) Int. Cl.
*B65D 85/24* (2006.01)

(52) U.S. Cl. ..... 206/337; 206/232; 206/342; 206/463; 206/470

(58) Field of Classification Search ..... 206/232, 206/337, 338, 342, 461–464, 467, 470, 471, 206/703–705
See application file for complete search history.

(56) References Cited

U.S. PATENT DOCUMENTS

| | | | | |
|---|---|---|---|---|
| 3,776,375 | A * | 12/1973 | Rohdin | 206/470 |
| 4,091,927 | A * | 5/1978 | Lunsford | 206/461 |
| 4,619,364 | A | 10/1986 | Czopor, Jr. | |
| 4,842,143 | A * | 6/1989 | McKee et al. | 206/463 |
| 5,520,939 | A * | 5/1996 | Wells | 206/471 |
| 5,560,490 | A * | 10/1996 | Chawla | 206/471 |
| 6,364,115 | B1 * | 4/2002 | Casanova et al. | 206/471 |
| 7,556,152 | B2 * | 7/2009 | Lechelle | 206/470 |
| 2006/0278561 | A1 * | 12/2006 | Schierlmann | 206/471 |

FOREIGN PATENT DOCUMENTS

| | | |
|---|---|---|
| DE | 83 13 166.3 U1 | 10/1984 |
| FR | 2 351 868 | 12/1977 |
| JP | 54-176540 | 12/1979 |
| JP | 59-062476 A | 4/1984 |
| JP | 59-196469 U | 12/1984 |
| JP | 60-013811 Y2 | 5/1985 |
| JP | 3057179 U | 12/1998 |

* cited by examiner

*Primary Examiner*—Luan K Bui
(74) *Attorney, Agent, or Firm*—Birch, Stewart, Kolasch & Birch, LLP

(57) ABSTRACT

Even when a storage container is placed upside down by mistake or in an inclined state, stored items are prevented from falling down or being disordered from an arranged state. A container body having a body recess for storing a lower side of the stored item and a lid member having a lid recess for storing an upper side of the stored item and being superimposed with the container body are provided, and the container body is provided with locking portions for locking the stored item at a plurality of points for applying separation resistance from the body recess to the stored item on the inner peripheral surface of the body recess of the container body.

10 Claims, 9 Drawing Sheets

STORAGE CONTAINER

BACKGROUND OF THE INVENTION

1. Field of the Invention

The present invention relates to a storage container in which items to be stored such as barrettes are stored individually.

2. Description of the Related Art

As a storage container having a container body and a lid member formed integrally of one synthetic resin sheet by vacuum molding, for example, the storage container as described in Japanese Registered Utility Model No. 3057179 is known. The storage container includes a container main body having a plurality of recesses which correspond to the lower side of a hen egg and a lid member having recesses which correspond to the remaining upper side of the hen egg, and the container main body and the lid member are connected to each other via a hinge portion.

The container disclosed in Japanese Utility Model No. 3057179 is configured to store a plurality of hen eggs individually between the lid member and the container main body by covering the container main body with the lid member.

The storage container disclosed in Japanese Utility Model No. 3057179 is not configured to lock the stored items individually to the lid member or the container main body. Therefore, when an attempt is made to take out the stored items from the storage container in an inclined posture, the stored items (hen eggs) are in danger of breaking away from a storage portion.

When the stored items are toilet requisites such as barrettes, the container is used upside down by mistake or in the inclined posture very often in beauty salon, and hence there arises problems such that arrangement of the stored items in the storage container become disordered in an arranged state or that the stored items fall down from the storage container.

SUMMARY OF THE INVENTION

In view of such a problem described above, it is an object of the present invention to provide a storage container in which stored items are restrained or prevented from falling down or being disordered from the arranged state even when the storage container is placed upside down by mistake or in an inclined state.

In order to achieve the above-described object, the invention provides technical means as described below.

In other words, the invention provides a storage container including a container body having a body recess for storing a lower side of a stored item and a lid member having a lid recess for storing an upper side of the stored item and being superimposed with the container body, in which the container body is provided with locking portions which lock the stored item at a plurality of points apart from each other and apply separation resistance from the body recess to the stored item on an inner peripheral surface of the body recess of the container body.

The storage container in the invention includes a container body having a plurality of the body recesses for storing lower sides of elongated stored items arranged in parallel to each other and a lid member having a plurality of lid recesses for storing upper sides of the stored items and being superimposed with the container body, in which the container body and the lid member are formed integrally with each other of a synthetic resin sheet via a bendable portion, and the container body includes locking portions which lock the stored items at a plurality of points apart from each other and apply separation resistance from the body recesses to the stored items on the inner peripheral surfaces of the body recesses of the container body.

Accordingly, even when the storage container is placed upside down by mistake or in the inclined state, the stored items are locked in the body recesses by the locking portions, and hence separation of the stored items from the body recesses is restricted. Therefore, the stored items are restrained or prevented from falling down or being disordered from the arranged state while allowing taking out of the stored items.

Preferably, the locking portions are locking projections projecting from the inner peripheral surfaces of the body recesses toward the stored items, or locking recesses depressed from the inner peripheral surfaces of the body recesses.

Accordingly, the locking portions are formed easily in the body recesses.

Preferably, the container body and the lid member oppose to each other at portions around the body recesses and the lid recesses in a superimposed state and include flat portions continuing from the body recesses and the lid recesses, shouldered portions bent from an outer peripheral edges of the flat portions, and outer peripheral edge portions bent from the shouldered portions and extend in substantially parallel to the flat portions.

Accordingly, the container body and the lid member are superimposed to each other along the surfaces of the flat portions, the shouldered portions and the outer peripheral edge portions in surface contact with each other, so that air-tightness of portions where the stored items are stored is increased, and entering of foreign substances into the interior of the container is restrained.

The shouldered portions of the container body and the lid member are provided with lock guide portions and locked guide portions to be engaged with each other for applying separation resistance from the superimposed state.

Accordingly, the container body and the lid member are reliably engaged.

The lid member is formed of transparent synthetic resin and is provided with an item instruction sheet between the flat portions of the container body and the lid member.

Accordingly, the item instruction sheet provided between the container body and the lid member is visualized through the flat portions and the advertisement or advisory on the item instruction sheet are visualized for the user easily and effectively.

Preferably, the stored items are elongated barrettes having locked portions which are engageable with the locking portions at both ends in the longitudinal direction.

According to the storage container in the invention, even when the storage container is placed upside down by mistake or in an inclined state, the stored items are locked in the body recesses by the locking portions and separation of the stored items from the body recesses is restricted. Therefore, the stored items are restrained or prevented from falling down or being disordered from the arranged state while allowing taking out of the stored items.

DETAILED DESCRIPTION

Figure 1:
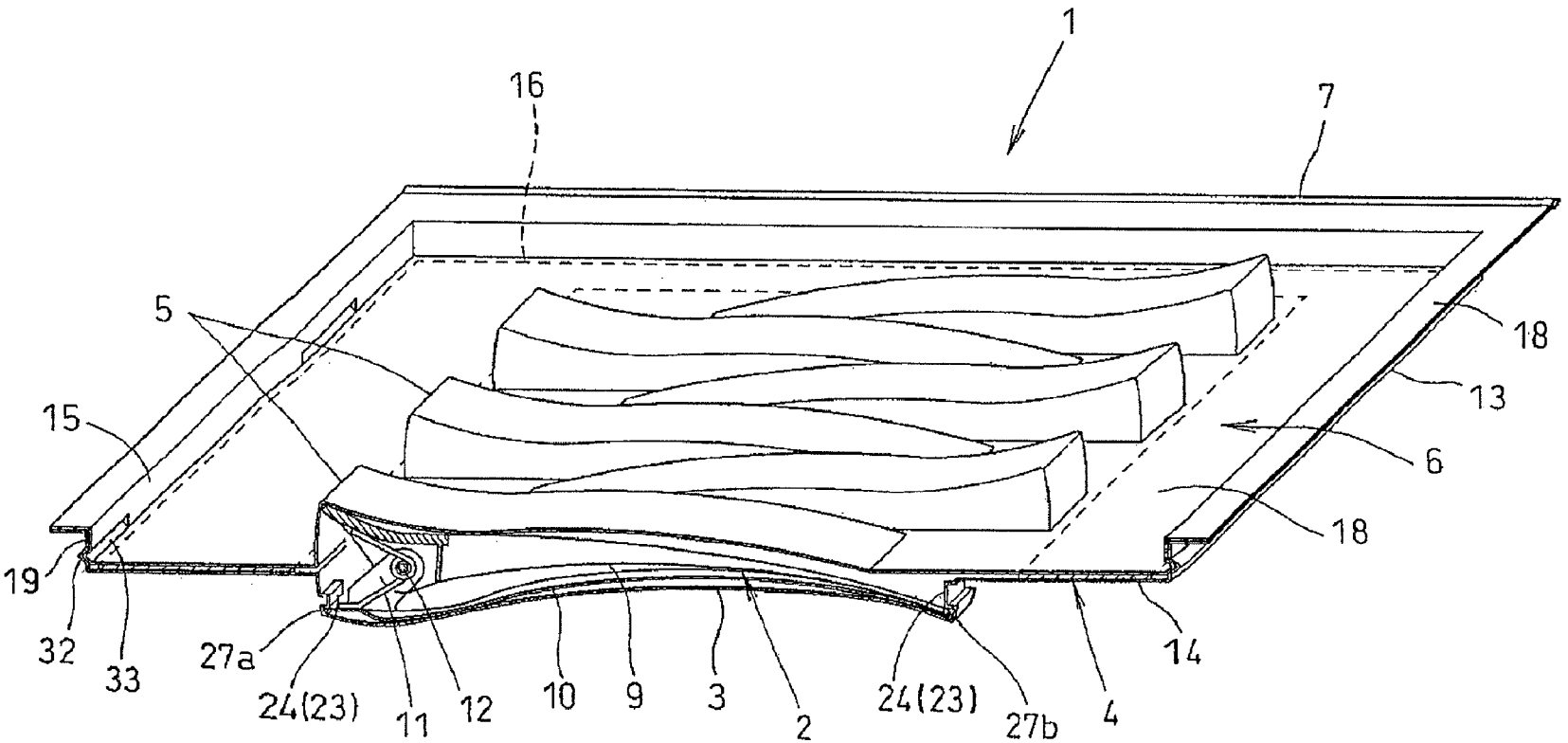
FIG. 1 is a perspective view of a storage container, partly in cross-section, according to the invention.

Referring to FIG. 1 to FIG. 9, embodiments of a storage container according to the invention will be described below.

In FIG. 1 to FIG. 7, a storage container 1 according to a first embodiment includes a lower container body 4 and an upper lid member 6 formed integrally from a transparent synthetic resin sheet via a bendable portion 7. The container body 4 is formed with body recesses 3 for storing lower sides of stored items 2 exemplified by barrettes, and the lid member 6 is formed with lid recesses 5 for storing upper sides of the stored items 2. Locking portions 23 for locking the items 2 to be stored at a plurality of points apart from each other are provided on the inner peripheral surface of the body recesses 3 of the container body 4. Provided between the container body 4 and the lid member 6 is an item instruction sheet 16 for the item.

Figure 2:
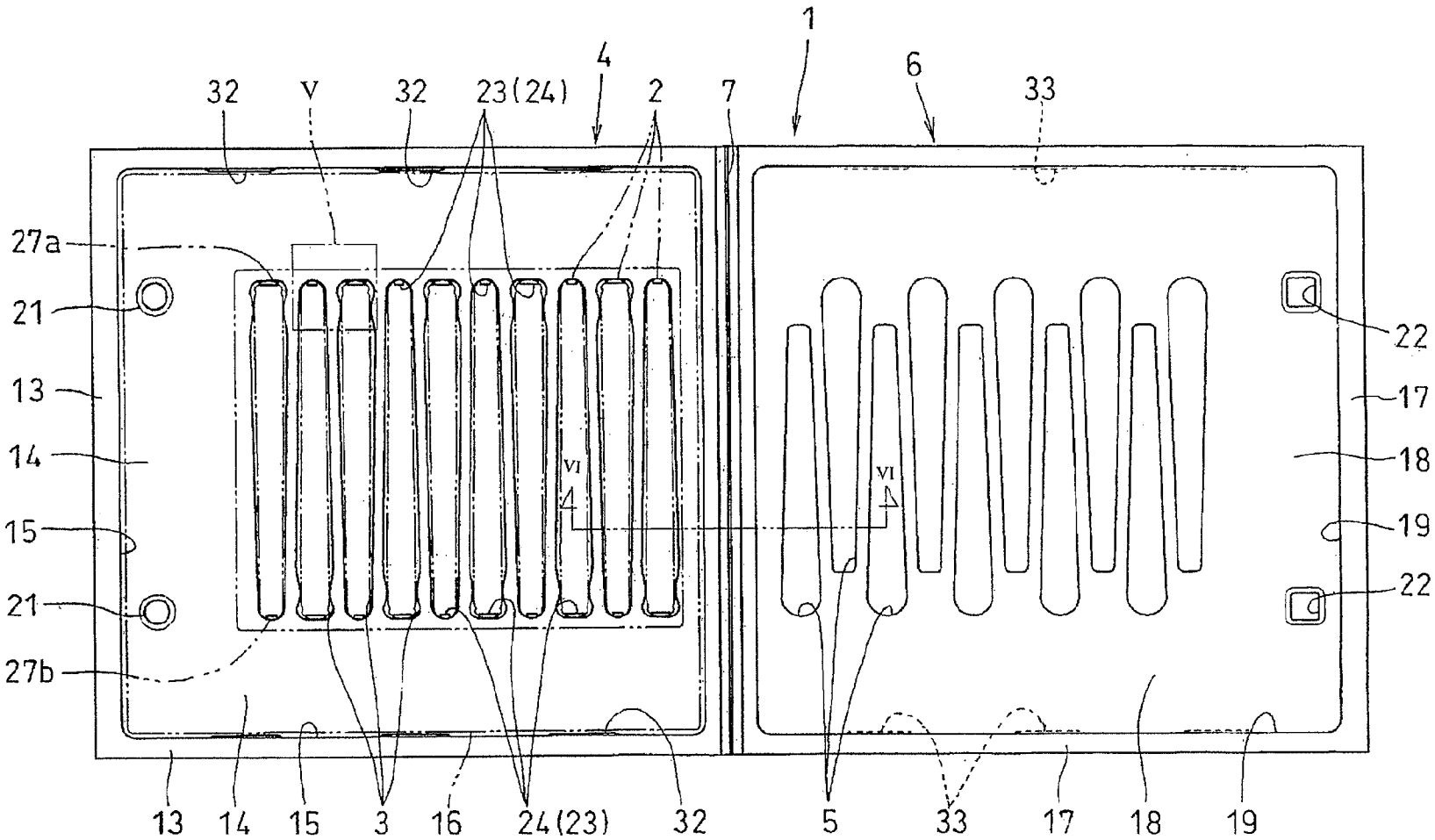
FIG. 2 is an expansion plan view of the storage container.

As shown in FIG. 2, the container body 4 is formed into a substantially square shape, and is provided with a plurality (ten in this embodiment) of the body recesses 3 for storing the lower sides of the barrettes 2 (stored items) at the center in line.

The container body 4 includes a body flat portion 14 which continuously in contact with body recesses 3 around the body recesses 3, a body shoulder portion 15 bent upward from the body flat portion 14, and a body outer peripheral edge 13 bent in the horizontal direction from the body shoulder portion 15 and extending in substantially parallel with the body flat portion 14. The container body 4 is provided with the bendable portion 7 on the rear side (at the lateral center in FIG. 2) of the container body 4.

The container body 4 includes engaging portions 21 projecting upward from the body flat portion 14 on the front side (left side in FIG. 2) of the body flat portion 14. The engaging portion 21 is formed into a column shape in this embodiment, and two of such engaging portions 21 are formed on the body flat portion 14.

The lid member 6 is formed into a substantially square shape like the container body 4. The lid member 6 is provided with a plurality of the lid recesses 5 at the center thereof for storing upper sides of the barrettes 2 at positions opposing the body recesses 3 when the lid member 6 is superimposed on the container body 4. The lid recesses 5 are provided in line by the same number and in the same direction as the body recesses 3 of the container body 4.

The lid member 6 includes a lid flat portion 18 continuously in contact with the lid recesses 5 around the lid recesses 5, a lid shoulder portion 19 bent downward from the lid flat portion 18, and a lid outer peripheral edge 17 bent from the lid shoulder portion 19 in the horizontal direction and extending in substantially parallel to the lid flat portion 18. Provided between the lid member 6 and the container body 4 is the bendable portion 7.

The lid member 6 includes engaged portions 22 depressed from the lid flat portion 18 on the front side (right side in FIG. 2) of the lid flat portion 18. The engaged portions 22 are formed into a size which the engaging portions 21 are able to be fitted so as to be disengageably fitted to the engaging portions 21 projecting upward from the body flat portion 14. The engaged portions 22 are formed into a square hole shape in this embodiment, and two of such engaged portions are provided corresponding to the engaging portions 21.

Figure 3:
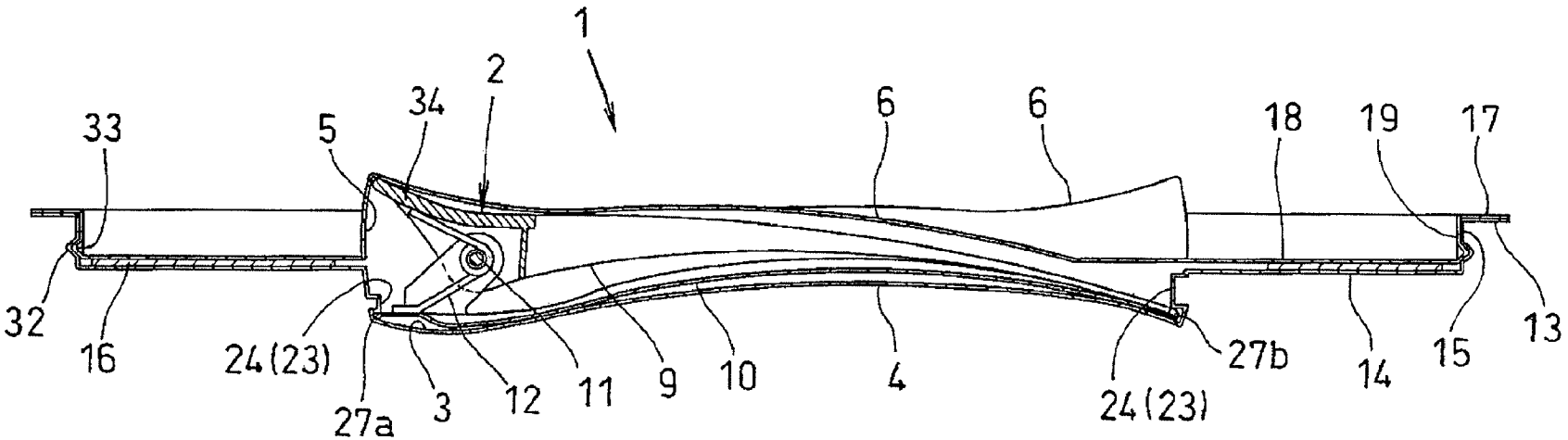
FIG. 3 is a cross-sectional view of a principal portion of the storage container.

As shown in FIG. 2 and FIG. 3, the right and left (right and left in FIG. 3) portions of the body shoulder portion 15 of the container body 4 are formed with locked guide portions 33 depressed from the inner surface of the body shoulder portion 15. On the other hand, the right and left portions of the lid shoulder portion 19 of the lid member 6 are formed with projecting lock guide portions 32 on the outer surface of the lid shoulder portion 19. The lock guide portions 32 have a shape being able to fit to the locked guide portions 33, and are provided at positions corresponding to each other. When the lock guide portions 32 are fitted to the locked guide portions 33, the lid member 6 comes into well tight contact with the container body 4, and the lid member 6 is prevented from coming apart easily from the container body 4.

Figure 5:
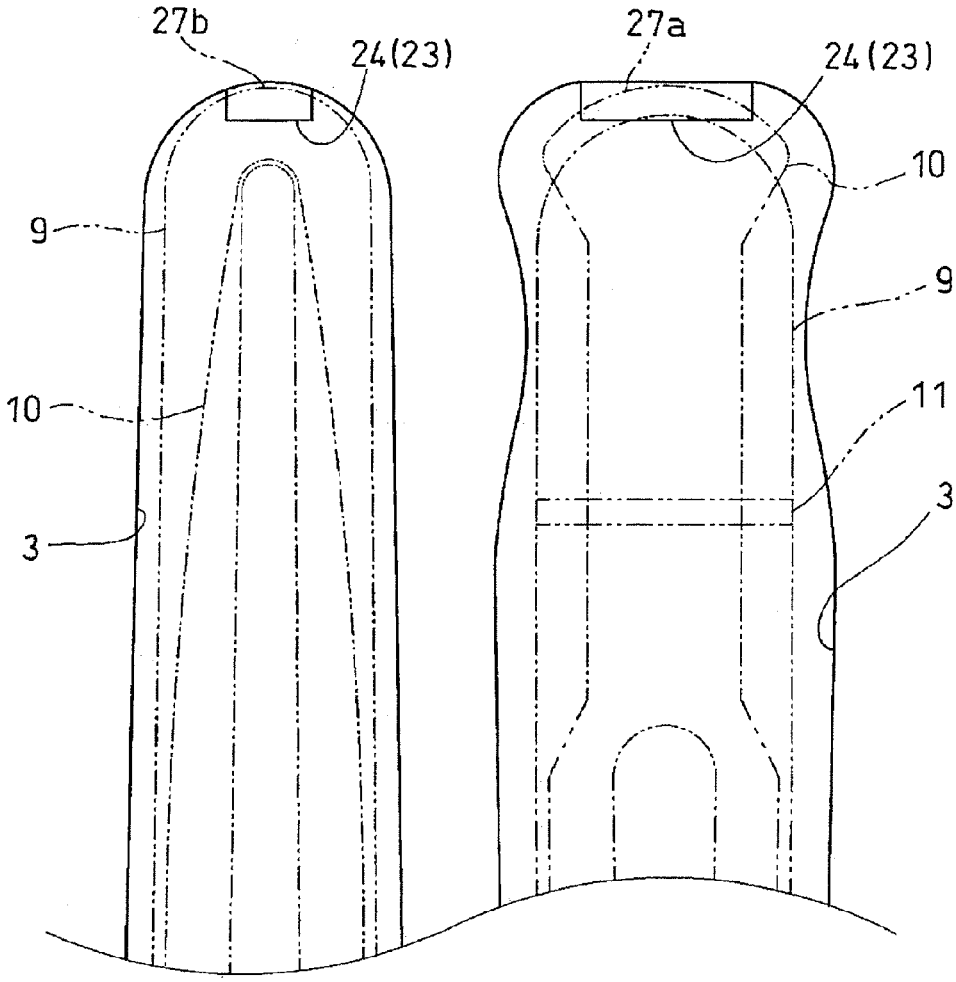
FIG. 5 is a plan view of a portion V in FIG. 2 in an enlarged scale.

As shown in FIG. 5, the bendable portion 7 is provided between the container body 4 and the lid member 6, and the bendable portion 7 is integrally formed with the container body 4 and the lid member 6 of the same synthetic resin sheet as the synthetic resin from which the container body 4 is formed. The bendable portion 7 is formed by bending the synthetic resin sheet by a plurality of times along the lateral direction, and connects the container body 4 and the lid member 6 in a state of being capable of turning over by a plurality of times.

The item instruction sheet 16 is provided between the container body 4 and the lid member 6 as shown in FIG. 2. The item instruction sheet 16 is a sheet on which information such as specifications, usage instructions, handling advisory and advertisement of the barrettes 2 is described or printed. The item instruction sheet 16 is provided on a portion of the body flat portion 14 other than the engaging portions 21 and the body recesses 3.

On the other hand, the container body 4 or the lid member 6 are formed of a transparent thermoplastic synthetic resin sheet, and hence the body flat portion 14 and the lid flat portion 18 are also transparent. Therefore, the item instruction sheet 16 is visible through the body flat portion 14 or the lid flat portion 18, so that the information such as specifications, usage instructions, handling advisory and advertisement of the barrettes 2 is reliably transmitted to the user.

Figure 4:
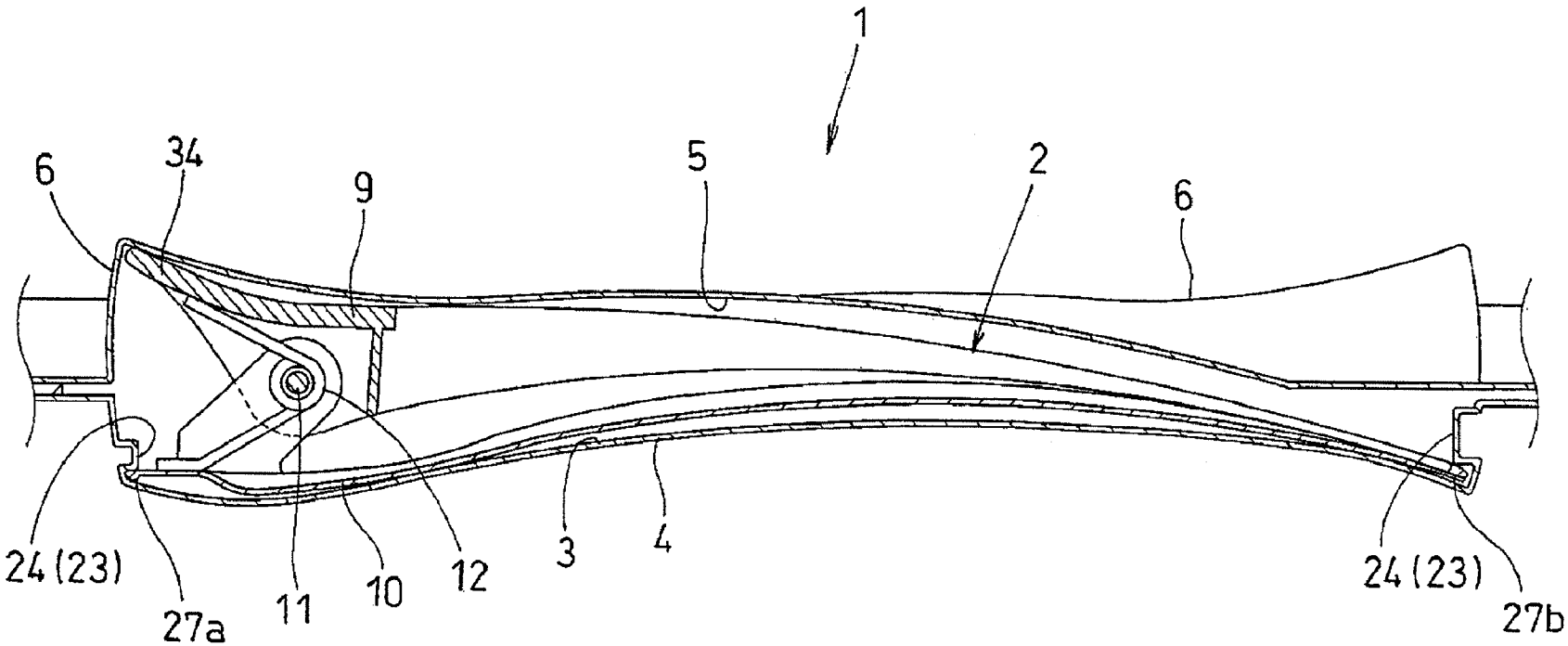
FIG. 4 is a cross-sectional view of the principal portion shown in FIG. 3 in a further enlarged scale.

As shown in FIG. 4, the barrettes 2 (stored items) are formed by pivotally fitting a barrette body 9 provided on the upper side and a pinching member 10 provided on the lower side to each other at midsections of the barrette body 9 and the pinching member 10. The barrette body 9 and the pinching member 10 each are formed into a longitudinally curved rod shape having the substantially same length. In this embodiment, the barrette body 9 is formed of synthetic resin, and the pinching member 10 is formed of metal.

Provided at the midsections of the barrette body 9 and the pinching member 10 is a pivotally supporting pin 11, and the barrette body 9 and the pinching member 10 are connected by the pivotally supporting pin 11 so as to be rotatable about the pivotally supporting pin. A spring 12 urges the barrette body 9 and the pinching member 10 in such a manner that distal sides (right side in FIG. 4) thereof get close to each other.

Therefore, the barrette 2 is capable of pinching hair by the distal side thereof and is capable of staying on the hair by itself.

Locked portions 27 which are able to be locked by the locking portions 23 of the body recesses 3 are formed at both ends in the longitudinal direction of the barrette 2. The locked portions 27 include a proximal locked portion 27*a* provided on the proximal side of the pinching member 10 and distal locked portions 27*b* provided on the distal sides of the barrette body 9 and the pinching member 10.

The barrette body 9 is formed with a hold-down portion 34 at the proximal side thereof, and the hold-down portion 34 is curved in the direction of coming away from the pinching member 10 as it goes toward the proximal side, thereby projecting upward.

Figure 6:
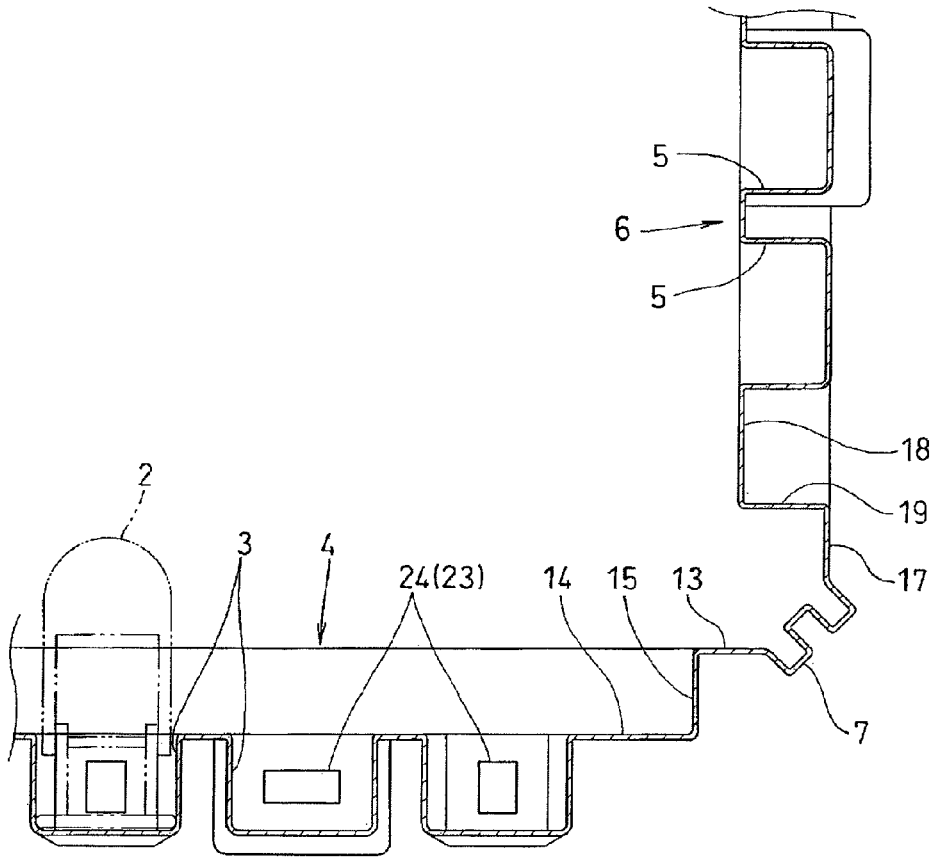
FIG. 6 is a cross-sectional view taken along the line VI-VI in FIG. 2.

Referring now to FIGS. 4 to 6, the locking portions 23 of the storage container 1 according to the invention will be described in detail.

As shown in FIGS. 4 to 6, the body flat portion 14 of the container body 4 is provided with the body recesses 3 formed to be depressed from the body flat portion 14, and the lid flat portion 18 of the lid member 6 is formed with the lid recesses 5 so as to be depressed from the lid flat portion 18. The body recesses 3 and the lid recesses 5 are provided at positions corresponding to each other, and the barrettes 2 are stored between the body recesses 3 and the lid recesses 5.

A plurality (ten in this embodiment) of the body recesses 3 are arranged in line in the fore-and-aft direction. The body recesses 3 are arranged in substantially parallel to each other, and are formed alternately so that the distal sides and the proximal sides of the adjacent barrettes 2 stored in the body recesses 3 are placed on the opposite sides. The body recesses 3 each include the locking portions 23 for locking the locked portions 27 on the distal side and the proximal side of the barrette 2 at both ends thereof apart from each other in the longitudinal direction of the barrette 2.

The lid recesses 5 are arranged in line on the lid flat portion 18 along the fore-and-aft direction by the same number as the body recesses 3. The lid recesses 5 are formed in an arrangement in substantially parallel to each other and alternately in the same manner as the body recesses 3 so that the lid recesses 5 are positioned right above the body recesses 3 when the lid member 6 is superimposed on the container body 4. The lid recesses 5 each are formed in such a manner that the portion which corresponds to the hold-down portion 34 on the proximal side of the barrettes 2 projects upward to the largest extent, so that the hold-down portion 34 which projects upwardly of the lid flat portion 18 are covered.

The inner peripheral surfaces of the body recesses 3 each are provided with the locking portions 23 which apply separation resistance from the body recess 3 to the barrette 2 by locking a plurality of points of the barrettes 2 located apart from each other. In other words, the locking portions 23 are provided on the inner peripheral surface of the body recess 3 in a stepped state for restricting the upward movement of the barrette 2 when the barrettes 2 is moving upward from the body recess 3, and release the engagement with the barrette 2 by being resiliently deformed by itself when the barrettes 2 move upward with a force stronger than a certain degree.

The locking portions 23 may take forms such as locking projections 24 projecting from the inner peripheral surface of the body recess 3 toward the barrette 2, locking recesses 25 depressed from the inner peripheral surface of the body recess 3, or pinching projections 26 projecting from widthwise both sides of the inner peripheral surface of the body recess 3 toward the barrette 2. In the first embodiment, an example in which the locking projections 24 are employed as the locking portions 23 is shown.

The locking projections 24 project from the inner peripheral surface of the body recess 3 toward the barrette 2 along the lateral direction (lateral direction in FIG. 4) so as to allow the locked portions 27 of the barrette 2 to fit between the locking projections 24 and the bottom surface of the body recess 3.

The locking projections 24 include a proximal locking projection 24*a* provided at an end portion of the body recess 3 corresponding to the proximal side of the barrette 2 and a distal locking projection 24*b* provided at an end portion thereof corresponding to the distal side of the barrette 2. The proximal locking projection 24*a* engages a proximal locked portion 27*a* of the body recess 3 and the distal locking projection 24*b* engages a distal locked portion 27*b* of the body recess 3. Accordingly, the locking projections 24 lock the barrette 2 to the body recess 3 in a state in which the barrette body 9 and the pinching member 10 are superimposed with each other.

Subsequently, a case in which the barrette 2 is locked with the locking portions 23 of the body recess 3 and a case in which the locked state between the locking portions 23 and the locked portions 27 of the barrette 2 will be described.

When locking the barrette 2 with the locking portions 23 of the body recess 3, the barrette 2 is brought to a proximity of the body recess 3 of the container body 4 from above. When the locked portions 27 provided at the longitudinally both ends of the barrette 2 come into contact with the locking portions 23 of the body recess 3, the locking portions 23 formed of resiliently deformable synthetic resin is deformed, and the locked portions 27 of the barrette 2 engage the locking portions 23, so that the barrette 2 is locked in the body recess 3.

While the locked portions 27 of the barrette 2 are locked with the locking portions 23 of the body recess 3, the locking portions 23 restrict the barrette 2 from separating from the body recess 3, so that the engagement between the locked portions 27 and the locking portions 23 are not released unless a force to a degree that resiliently deforms the locking portions 23 is applied to the barrette 2. Therefore, even when the storage container 1 is placed upside down by mistake or in the inclined state, the barrettes 2 are restrained or prevented from falling down from the storage container 1 or from being disordered from the arranged state.

On the other hand, when separating the barrette 2 from the body recess 3, the hold-down portion 34 of the barrette 2 projecting upwardly of the body flat portion 14 is pinched and the barrette 2 is moved upward. On the other hand, since the locking portions 23 are formed of resiliently deformable synthetic resin, the locking portions 23 are resiliently deformed so that engagement between the locked portions 27 and the locking portions 23 of the barrette 2 is easily released. Therefore, the barrettes 2 are taken out from the body recess 3 easily.

The barrette 2 is locked in the body recess 3 by providing the locking portions 23 which locks the both ends of the barrette 2 apart from each other in the longitudinal direction on the inner peripheral surface of the body recesses 3 to apply separation resistance from the body recess 3 to the barrette 2. In other words, since the locking portions 23 restrict the barrettes 2 from separating from the body recess 3, even when the storage container 1 is placed upside down by mistake or in the inclined state, the barrettes 2 are restrained or prevented from falling down from the storage container 1 or from being disordered from the arranged state.

The container body 4 includes the body flat portion 14 continuously in contact with the body recesses 3, the body shoulder portion 15 bent from the body flat portion 14, and the body outer peripheral edge 13 bent from the body shoulder portion 15 and extends in substantially parallel to the body flat portion 14. The lid member 6 includes the lid flat portion 18 continuously in contact with the lid recesses 5, the lid shoulder portion 19 bent from the lid flat portion 18, and the lid peripheral edge portion 17 bent from the lid shoulder portion 19 and extends in substantially parallel to the lid flat portion 18.

When the lid member 6 is superimposed on the container body 4, the body flat portion 14 and the lid flat portion 18, the body shoulder portion 15 and the lid shoulder portion 19, and the body outer peripheral edge 13 and the lid outer peripheral edge 17 are superimposed with each other in surface contact. Therefore, the container body 4 and the lid member 6 are superimposed with each other without any gap and hence entering of moisture content or foreign substance in the storage container 1 is restrained or prevented.

The barrette 2 is reliably locked in the body recess 3 in a simple structure by employing the locking projections 24 projecting from the inner peripheral surface of the body recess 4 toward the barrette 2 as the locking portions 23 and constituting the locking projections 24 with the proximal locking projection 24*a* which engages the proximal locked portion 27*a* of the barrette 2 and the distal locking projection 24*b* which engages the distal locked portion 27*b* of the barrette 2.

The item instruction sheet 16 is visualized through the body flat portion 14 or the lid flat portion 18 by forming the lid member 6 of transparent synthetic resin and providing the item instruction sheet 16 between the body flat portion 14 of the container body 4 and the lid flat portion 18 of the lid member 6, so that the advertisement or advisory on the item instruction sheet 16 are visualized for the user easily and effectively.

Subsequently, the storage container 1 according to a second embodiment will be described.

Figure 7:
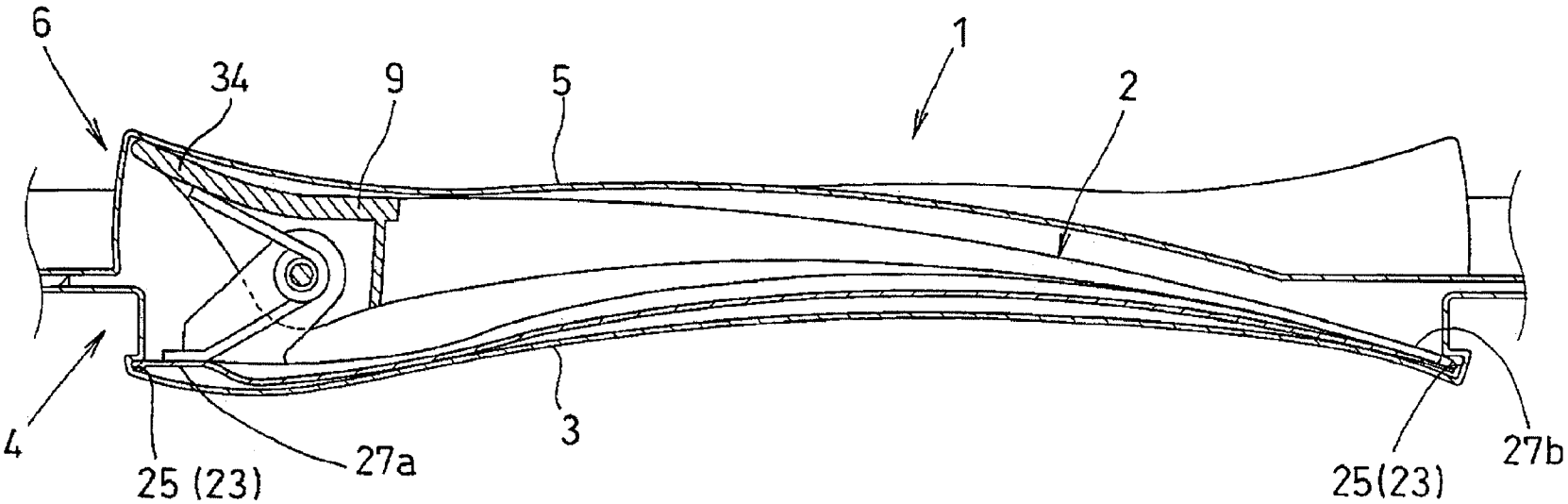
FIG. 7 is a cross-sectional view of a principal portion of the storage container according to a second embodiment.

As shown in FIG. 7, the different point of the storage container 1 in the second embodiment from the first embodiment is that the locking portions 23 are locking recesses 25 formed into a depressed shape on the inner peripheral surface of the body recess 3.

In other words, the locking recesses 25 according to the second embodiment are formed in a depressed shape on the inner peripheral surfaces of the body recess 3, and the locking recesses 25 are formed into a shape which matches the shape of the locked portions 27 of the barrette 2 so that the both ends of the barrette 2 in the longitudinal direction fit therein.

The locking recesses 25 each include a proximal locking recess 25*a* provided at an end of the body recess 3 corresponding to the proximal side of the barrette 2 and a distal locking recess 25*b* provided at an end of the body recess 3 corresponding to the distal side of the barrette 2. The proximal locking recess 25*a* engages the proximal locked portion 27*a* of the barrette 2 and the distal locking recess 25*b* engages the distal locked portion 27*b* of the barrette 2. Accordingly, the locking recesses 25 locks the barrette 2 to the body recesses 3 in a state in which the barrette body 9 and the pinching member 10 are superimposed to each other.

The barrette 2 is reliably locked in the body recess 3 by the locking recesses 25 by employing the locking recesses 25 formed into the depressed shape on the inner peripheral surface the body recess 4 as the locking portions 23 and constituting the locking recesses 25 with the proximal locking recess 25*a* which engages with the proximal locked portion 27*a* of the barrette 2 and the distal locking recess 25*b* which engages the distal locked portion 27*b* of the barrette 2, so that the barrettes 2 are restrained or prevented from falling down from the storage container 1 or from being disordered from the arranged state.

Subsequently, the storage container 1 according to a third embodiment will be described.

Figure 8:
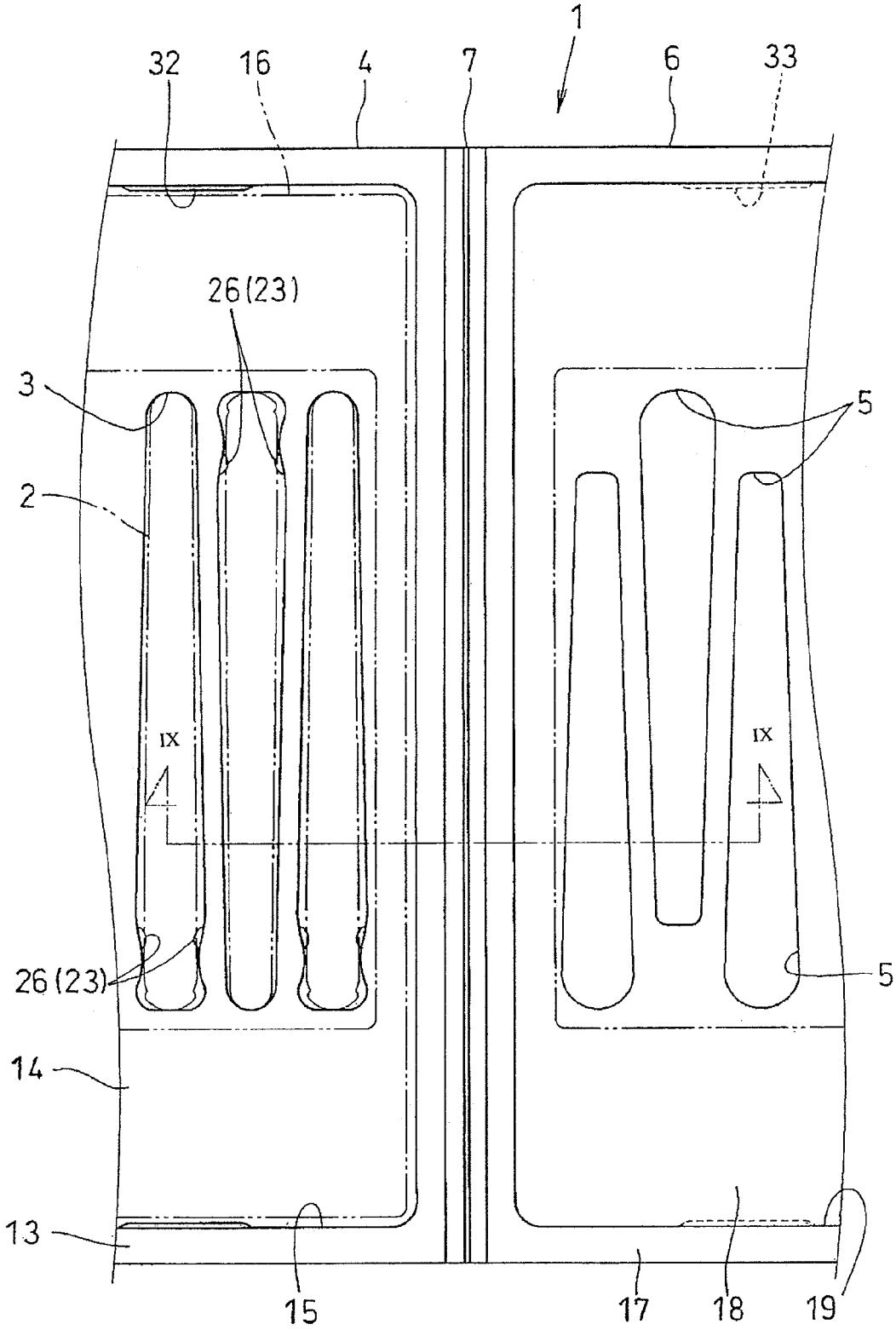
FIG. 8 is a plan view of the storage container according to a third embodiment.
Figure 9:
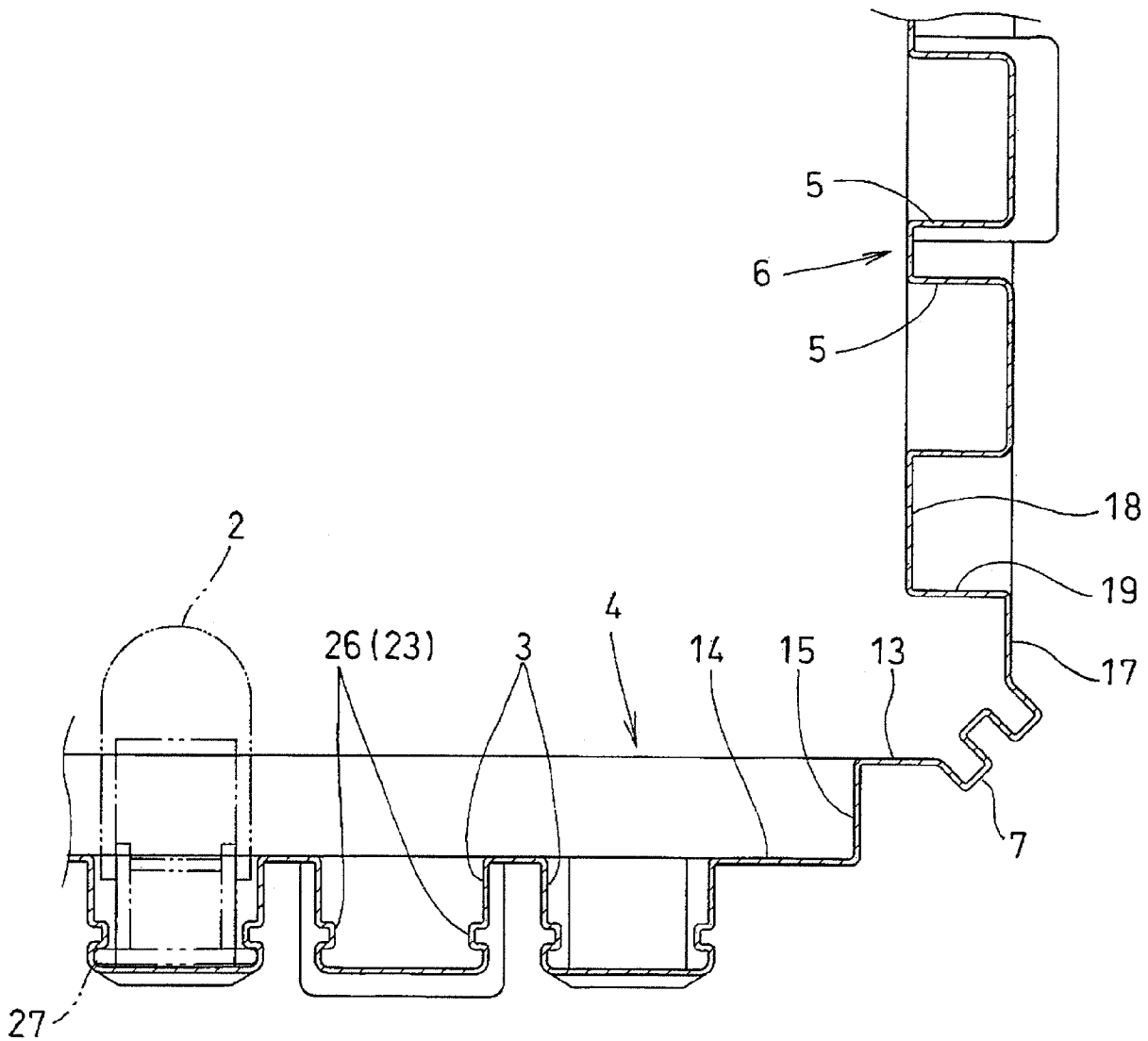
FIG. 9 is a cross-sectional view taken along the line IX-IX in FIG. 8.

As shown in FIG. 8 and FIG. 9, the different point of the storage container 1 in the third embodiment from the first embodiment is that the locked portions 27 are provided at both ends of the barrette 2 in the widthwise direction (lateral direction in FIG. 8) and that the pinching projections 26 which are able to engage the locked portions 27 are provided respectively on both sides of the barrettes 2 in the widthwise direction.

In other words, the pinching projections 26 in the third embodiment project from the inner peripheral surface on widthwise both sides of the body recess 3 toward the barrette 2, so that the barrette 2 is clamped from widthwise both sides.

The pinching projections 26 lock the barrette 2 reliably in the body recess 3 by providing the locked portions 27 on widthwise both sides of the barrette 2 and providing the pinching projections 26 which are able to engage the locked portions 27 on widthwise both sides of the barrette 2, so that the barrettes 2 are restrained or prevented from falling down from the storage container 1 or from being disordered from the arranged state.

The invention is not limited to the embodiments described above, and may be modified in shape, structure, material and combination of the respective members as needed without modifying the essence of the invention.

For example, in the embodiments shown above, the barrettes are exemplified as the stored items 2. However, the stored items 2 may be items other than the barrettes. It is also applicable to configure to store different kinds of stored items 2 such as hair bands or topknots other than the barrettes.

In the embodiment shown above, the locking portions 23 are all formed in the first recesses 3 of the container body 4. However, the locking portions 23 may be formed in the lid recesses 5 of the lid member 6.

What is claimed is:

1. A storage container comprising:

a stored item;

a container body having a body recess for storing a lower side of the stored item, the body recess having a bottom wall; and a lid member having a lid recess for storing an upper side of the stored item and being superimposed with the container body, wherein the container body includes locking portions on an inner peripheral surface of the body recess of the container body, an edge of the stored item retained between the locking portions and the bottom wall of the body recess, and wherein the stored item is an elongated barrette having edges which are engageable with the locking portions at both ends in a longitudinal direction.

2. The storage container according to claim 1, wherein the locking portions are locking projections projecting from the inner peripheral surfaces of the body recess toward the stored item, or locking recesses depressed from the inner peripheral surfaces of the body recess.

3. The storage container according to claim 2, wherein the container body and the lid member oppose each other at portions around the body recess and the lid recess in a superimposed state and the storage container including:

flat portions continuing from the body recess and the lid recess;

shoulder portions bent from an outer peripheral edges of the flat portions; and outer peripheral edge portions bent from the shoulder portions and extending substantially parallel to the flat portions.

4. The storage container according to claim 3, wherein the shoulder portions of the container body and the lid member include lock guide portions and locked guide portions to be engaged with each other for applying separation resistance from the superimposed state.

5. The storage container according to claim 4, wherein the lid member is formed of transparent synthetic resin and an item instruction sheet is placed between the flat portions of the container body and the lid member.

6. A storage container comprising:

elongated stored items;

a container body having a plurality of body recesses arranged in parallel to each other for storing lower sides of the elongated stored items, each body recess having a bottom wall; and a lid member having a plurality of lid recesses for storing upper sides of the stored items and being superimposed with the container body, wherein the container body includes locking portions on the inner peripheral surfaces of the body recesses of the container body, an edge of each elongated stored item retained between the locking portions and the bottom wall of the body recess, and wherein the stored items are elongated barrettes having edges which are engageable with the locking portions at both ends in the longitudinal direction.

7. The storage container according to claim 6, wherein the locking portions are locking projections projecting from the inner peripheral surfaces of the body recesses toward the stored items, or locking recesses depressed from the inner peripheral surfaces of the body recesses.

8. The storage container according to claim 7, wherein the container body and the lid member oppose each other at portions around the body recesses and the lid recesses in a superimposed state; and the storage container including:

flat portions continuing from the body recesses and the lid recesses;

shoulder portions bent from an outer peripheral edges of the flat portions; and outer peripheral edge portions bent from the shoulder portions and extending substantially parallel to the flat portions.

9. The storage container according to claim 8, wherein the shoulder portions of the container body and the lid member include lock guide portions and locked guide portions to be engaged with each other for applying separation resistance from the superimposed state.

10. The storage container according to claim 9, wherein the lid member is formed of transparent synthetic resin and an item instruction sheet is placed between the flat portions of the container body and the lid member.

* * * * *

UNITED STATES PATENT AND TRADEMARK OFFICE

CERTIFICATE OF CORRECTION

PATENT NO. : 7,886,905 B2
APPLICATION NO. : 12/000201
DATED : February 15, 2011
INVENTOR(S) : Katsuyoshi Kamada It is certified that error appears in the above-identified patent and that said Letters Patent is hereby corrected as shown below:

ON THE TITLE PAGE:

Item (73), Assignee, change "Goriki Kogyo Co., Ltd., Osaka-shi, Osaka (JP)" to --Goriki Kogyo Co., Ltd., Higashi-Osaka-shi, Osaka (JP)--.

Signed and Sealed this
Twentieth Day of December, 2011

David J. Kappos

David J. Kappos
*Director of the United States Patent and Trademark Office*